United States Patent [19]

Prsala

[11] Patent Number: 4,678,187

[45] Date of Patent: Jul. 7, 1987

[54] EXERCISE DEVICE TO SUPPORT USER'S BODY

[76] Inventor: Jan Prsala, P.O. Box 91, Site 12, R.R. #3, Armdale, Nova Scotia, Canada, B3L 4J3

[21] Appl. No.: 697,975

[22] Filed: Feb. 4, 1985

[30] Foreign Application Priority Data

Feb. 2, 1984 [CA] Canada ..... 446659

[51] Int. Cl.[4] ..... A63B 23/04

[52] U.S. Cl. ..... 272/144; 128/25 R; 272/134

[58] Field of Search ..... 272/136, 142, 93, 134, 272/112, 144, 94, 116–118, 126–131, 135, 137, 138, 139; 128/25 R, 25 B

[56] References Cited

U.S. PATENT DOCUMENTS

| | | | |
|---|---|---|---|
| 2,212,119 | 8/1940 | Jolsrud et al. | 272/93 |
| 2,682,402 | 6/1954 | McCarthy | 272/142 X |
| 3,606,315 | 9/1971 | Green | 272/112 |
| 3,622,154 | 11/1971 | Williams | 272/134 X |
| 4,204,676 | 5/1980 | Givens | 272/136 |
| 4,583,731 | 4/1986 | Crivello et al. | 272/144 |

OTHER PUBLICATIONS

"Free Standing Hip Flexor"–Universal catalog 1981, p. 13.

*Primary Examiner*—Richard J. Apley
*Assistant Examiner*—J. Welsh

[57] ABSTRACT

The invention relates to an exercise device capable of entirely supporting a person by the upper trunk through the use of the arm and back supports and by the feet through the use of the footrest. The upper trunk support (consisting of the arm and back supports) and the footrest are mounted on vertical posts on the solid rectangular frame, and one of the upper trunk support on the footrest is movable in relation to the other. The resilient material extends between the upper back support and the footrest and when stretched urges them together. When a person is properly positioned in the device, the person's body, at least from the lower back to the knees, is freely suspended, and by straightening the legs against the resistance of the resilient material, beneficial exercise for the development of the postural muscles may be achieved. By allowing the person's body, at least from the lower back to the knees, to be suspended freely during use of the device it is suitable for the prevention or treatment of lower back pain.

12 Claims, 3 Drawing Figures

EXERCISE DEVICE TO SUPPORT USER'S BODY

BACKGROUND OF THE INVENTION

1. Field of the Invention

The invention relates to an exercise device, in particular to an exercise device suitable for people suffering from lower back pain and similar problems.

2. Description of the Prior Art

Various exercise devices have been proposed, however they generally require that the user be either standing, sitting or lying to perform the exercise. Such devices are not satisfactory for some people with lower back pain, since the very position in which the exercise is performed, such as sitting, may well aggravate the condition. Accordingly it is an object of the instant invention to overcome these deficiencies in previous devices by providing a device that allows the person's body to be suspended freely from the lower back to the knees during exercise. In recent years, more attention has been paid to the problem of lower back pain and the instant invention seeks to provide an exercise device suitable for a person with a lower back pain or other such condition.

SUMMARY OF THE INVENTION

The instant invention offers a substantial improvement over the prior art as more fully described hereinafter.

There is provided an exercise device capable of entirely supporting a person by the upper trunk and feet of the person consisting of an upper trunk support, a footrest, and a resilient material to urge the upper trunk support and the footrest together when it is stretched. In the device at least one of the upper trunk support and the footrest is movable in relation to the other, and when a person is properly positioned in the device the person's body, at least from the lower back to the knees, is freely suspended. When the legs are straightened against the resistance of the resilient material beneficial exercise may be achieved.

The instant invention allows a method of exercising wherein a person is entirely supported by his upper trunk and feet by means of an upper trunk support and by the positioning of the person's feet in contact with a footrest whereby the person's body, at least from the lower back to the knees, is freely suspended. None of the prior art allows the body to be suspended in this manner during exercise. In the device at least one of the upper trunk support and the footrest is movable in relation to the other and a resilient material urges the upper trunk support and the footrest together when stretched by alternately straightening and bending the legs of the person.

The upper trunk support may be of any kind suitable to comfortably support the user by his upper trunk. Thus, for example, the upper trunk support may be adapted to support the user by the upper arms and the upper back. Upper arms means that part of the arms between the elbows and armpits.

In the instant invention the upper trunk support is a pair of arm supports to support the upper arms which together with the footrest is mounted on a common frame. A support for the upper back, in fixed relation to the arm supports is also provided.

In the instant invention, the foot rest is a horizontal bar, and is movable in relation to the upper trunk support while the upper trunk support is fixed. The resilient means is a pair of springs. The foot rest is hinged to provide arcuate movement and further, a stopping device such as a fixed post and a cord connecting the post to the foot support, is provided to prevent the foot support from collapsing under the tension of the springs and the weight of the foot support.

In a variation of the instant invention the upper back support is movable in relation to the footrest and the footrest is fixed. The upper back support in this variation may be mounted on rolling bearings and the resilient material may be a set of compression springs connecting the upper back support to a fixed member. Freely suspended means that the person's body, at lease from the lower back to the knees, is free of the ground.

In another variation of the instant invention, the upper trunk support, consisting of the pair of arm supports, the upper back support and the seat support, is movable in relation to the footrest and the footrest is fixed. The upper trunk support is suspended on the main frame of the apparatus so that it can swing or rock back and forth. The upper trunk support is connected by a resilient material to the footrest which is fixed. During exercise the user supports himself by his upper arms and upper back so that his body is free of the seat support and is fully suspended from the upper back to the knees. Between sets of exercises the person rests by lowering himself onto the seat support.

DESCRIPTION OF THE PREFERRED EMBODIMENTS

Figure 1:
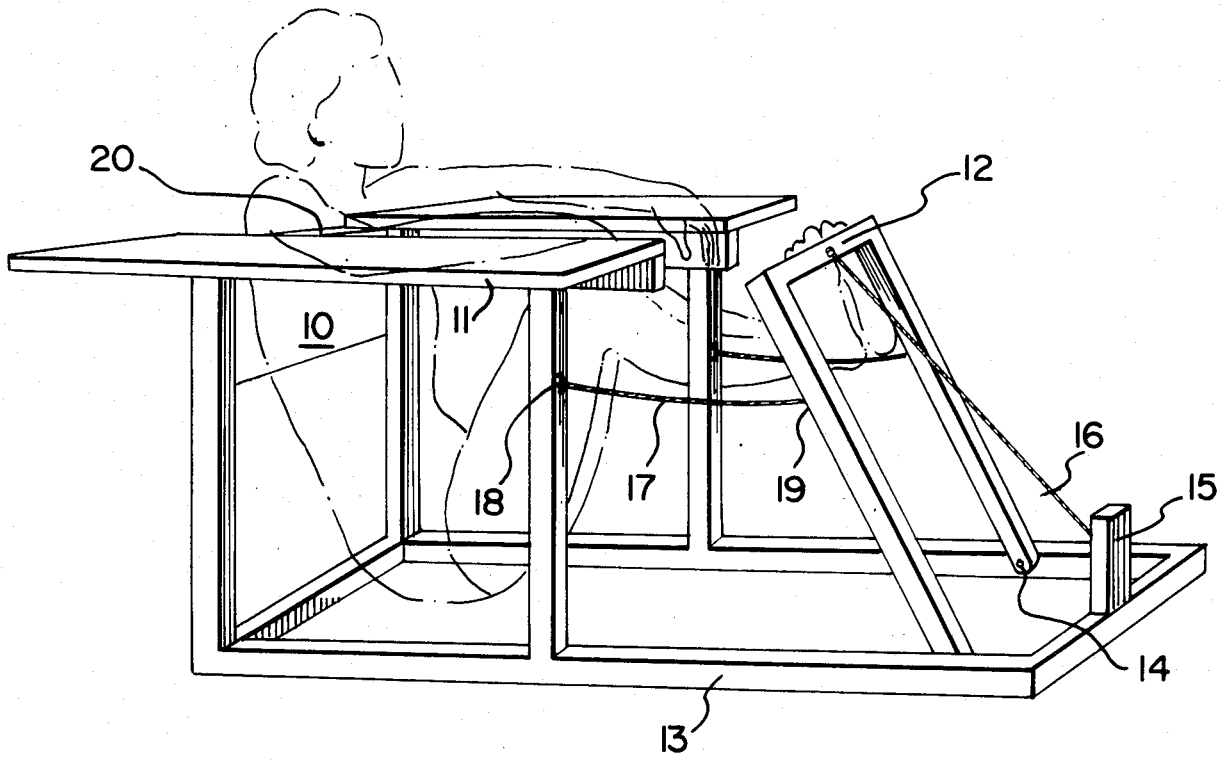
FIG. 1 of the drawing is a perspective view of the instant invention in operation.

As shown in the drawings a person 10 is supported by arm supports 11 with his feet resting on a footrest 12. The supports are mounted on the common frame 13 by an upright suspension means. The upright suspension means consisting of four rigid upright posts. The footrest is mounted to the common frame 13 by two rigid upright posts.

In FIG. 1 the foot rest 12 is hinged to common frame 13 by pivots 14 thus providing arcuate movement. The stopping device consists of a fixed post 15 and cord 16. The cord 16 is connected to both the foot rest 12 and the fixed post 15, thus movement of the foot rest 12 is limited by the extension of the cord 16 in one direction and by springs 17 in the other direction. Post 15 is preferably short enough to avoid interfering with arcuate movement of foot rest 12. The foot rest 12 and arm supports 11 are urged together by the resilient material such as elastic straps or springs 17. The springs 17 are connected to the arm supports at connection 18 and to the footrest 12 at connection 19. A backrest 20 supports the upper back of the person 10. Padding (not shown) may be provided on the backrest 20 and arm supports 11 for the comfort of the user.

Figure 2:
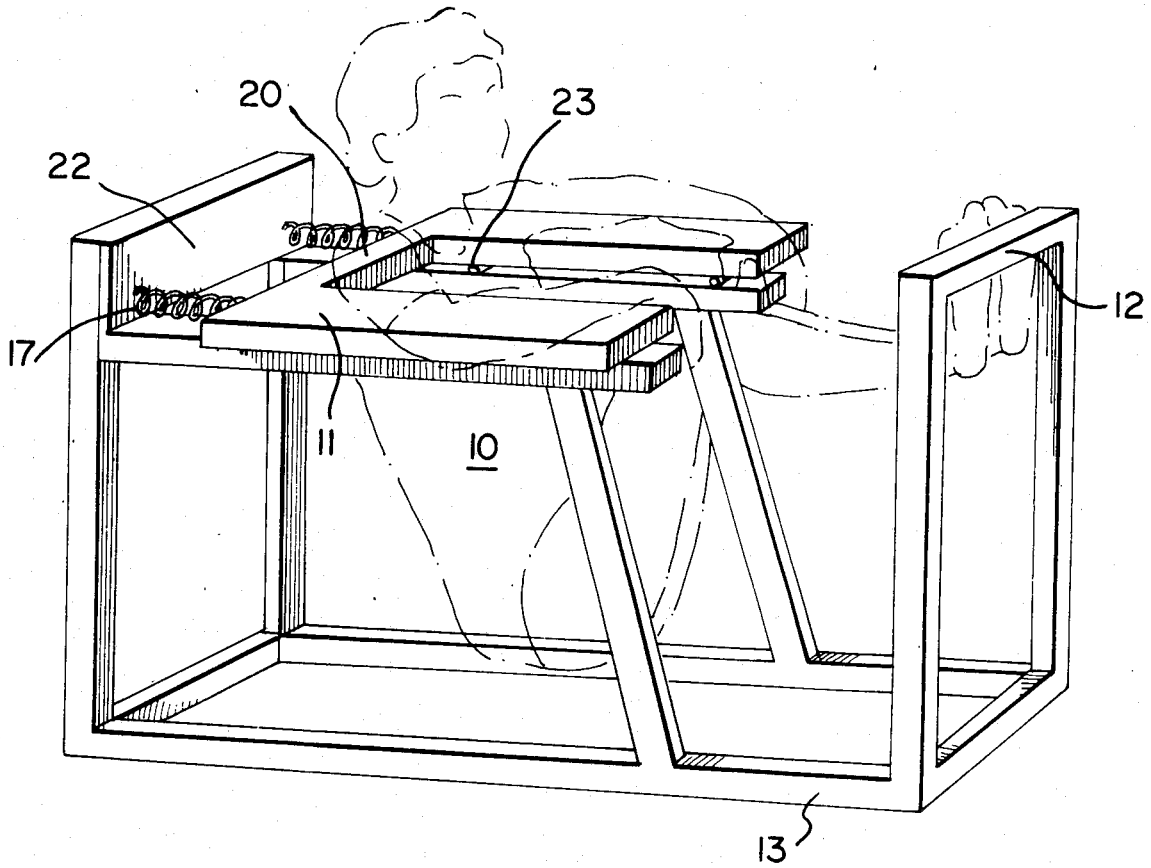
FIG. 2 of the drawings is a perspective view of a variation of the instant invention in which the upper trunk support is movable and the footrest is fixed.

In FIG. 2 the footrest 12 is fixed and the arm supports 11 are movable on common frame 13 by means of rolling bearing 23. Backrest 20 is connected in fixed relation to arm supports 11 and thus backrest 20 and arm supports 11 move together as a single unit. Springs 17 urge arm supports 11 and footrest 12 together when compressed. The springs connect the back support 20 to a fixed member shown in the drawings as the rear 22 of common frame 13.

Although FIG. 2 shows the backrest 20 and arm supports 11 moving in a horizontal plane, their plane of movement could also be inclined to provide an uphill gradient effectively increasing the resistance against which the user must push to exercise and assisting return to the "rest" position.

Figure 3:
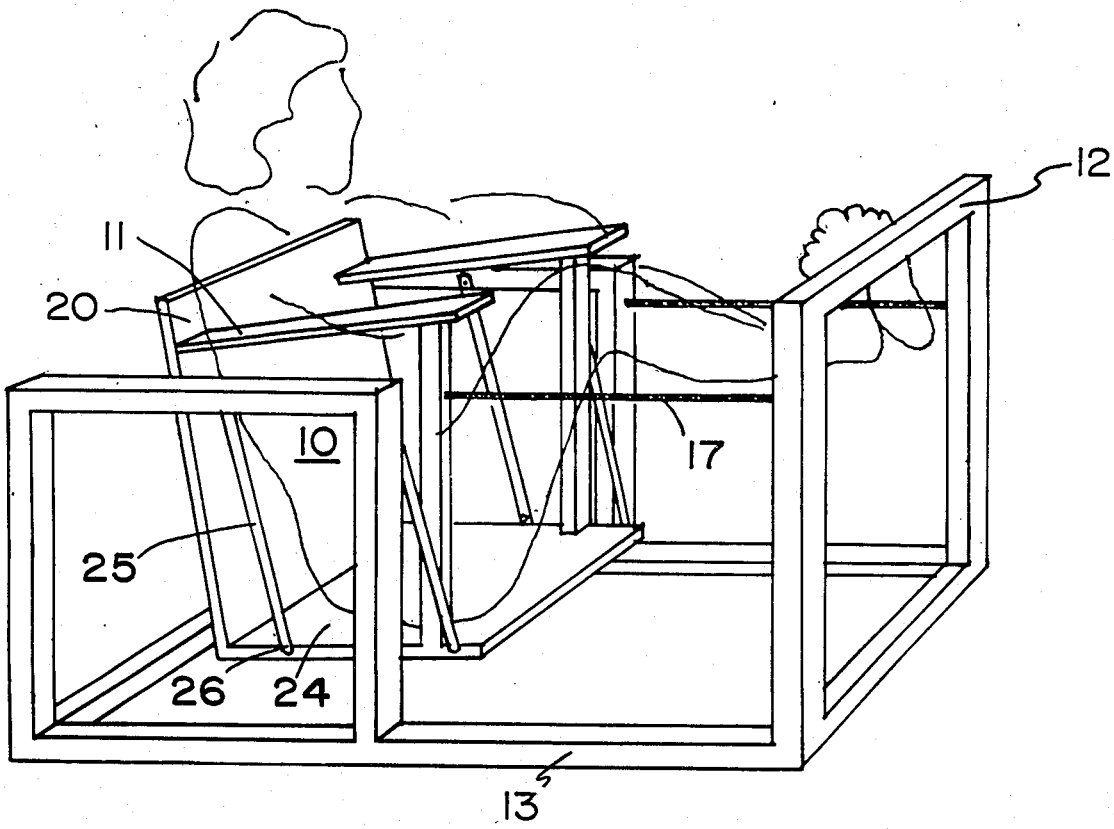
FIG. 3 of the drawings is a perspective view of a variation of the instant invention in which the footrest is fixed and the upper trunk support consisting of the arm supports, the upper back support and the seat support is movable.

In FIG. 3 the footrest 12 is fixed and the upper trunk support consisting of the arm supports 11, the upper back support 20 and the seat support 24, are movable in relation to the common frame 13. In FIG. 3 the upper trunk support is suspended on the common frame 13 by four bars 25, which may be constructed of metal or other rigid inflexible material. The four bars 25 are connected to the common frame 13 and seat support 24 by connecting materials 26 which permit rotary motion around the connecting materials 26 at both ends of the four bars 25. As a result the upper trunk support can swing back and forth as a single unit, as a result of the person's flexion and extension of the legs. Springs 17 connecting the upper trunk support and the footrest 12 urge the upper trunk support and footrest together. The footrest 12 is fixed.

In use the user simply positions himself as shown in the FIG. 1 by person 10 and then by alternately straightening and bending the legs against the resistance of springs 17 the body is exercised.

Having regard to the foregoing disclosure the following is claimed as the inventive and patentable embodiments thereof:

1. An exercise device comprising:

(a) a frame having a front and rear end;

(b) an upper trunk support comprising a unit including a pair of arm supports and a back support, said upper trunk support connected to said frame near said rear end by an upright suspension means;

(c) a footrest connected to said frame near said front end, wherein one of the upper trunk support or the footrest is movable in relation to the other and the other is fixed;

(d) a resilient means operatively connected to the movable one of the upper trunk support or the footrest for resisting movement thereof; and whereby the device entirely supports a person by the upper trunk and feet of the person so that the person's body, at least from the lower back to the knees, is freely suspended.

2. The device of claim 1, wherein the footrest is movable and the upper trunk support is fixed.

3. The device of claim 2, wherein the resilient means is connected to the footrest and upright suspensions means.

4. The device of claim 3, wherein the footrest is supported by two posts which are pivotally connected to the frame to provide arcuate movement of said footrest.

5. The device of claim 4, wherein the footrest has a stopping means consisting of a fixed post mounted to the front end of the frame and a cord connected between the footrest and the fixed post to prevent the footrest from collapsing under the tension of the resilient means.

6. The device of claim 1, wherein the upper trunk support is movable and the footrest is fixed.

7. The device of claim 6, wherein the pair of arm supports of said upper trunk support are mounted on rolling bearings and on a pair of horizontal bars which are supported by said upright suspension means.

8. The device of claim 7, wherein said frame is rectangular and said upright suspension means comprises four posts and two of said posts are attached to the rear of said frame and two are attached approximate the midpoint of said frame.

9. The device of claim 8, wherein the resilient means comprises a set of compression springs connected to said upper trunk support and a fixed member spanning across the two posts attached to the rear of the frame.

10. The device of claim 6, wherein the upper trunk support further comprises a seat support connected to said back support and said seat support being suspended from said upright suspension means by four bars which rotate freely at each end.

11. The device of claim 10, wherein the resilient means is connected to the upper trunk support and the footrest.

12. The device of claim 7 or 10, wherein the footrest is supported by two rigid posts attached to the front of the frame.

* * * * *